US006694887B2

(12) United States Patent
Diller

(10) Patent No.: US 6,694,887 B2
(45) **Date of Patent: *Feb. 24, 2004**

(54) SHOTGUN SHELL FLIGHT PATH INDICATOR

(76) Inventor: E. Wendell Diller, 3712 Garden Blvd. North, Oakdale, MN (US) 55109

( * ) Notice: Subject to any disclaimer, the term of this patent is extended or adjusted under 35 U.S.C. 154(b) by 0 days.

This patent is subject to a terminal disclaimer.

(21) Appl. No.: 10/379,263

(22) Filed: Mar. 4, 2003

(65) Prior Publication Data

US 2003/0159611 A1 Aug. 28, 2003

Related U.S. Application Data

(62) Division of application No. 10/219,024, filed on Aug. 15, 2002, now Pat. No. 6,539,873, which is a continuation of application No. 09/592,475, filed on Jun. 9, 2000, now abandoned.

(51) Int. Cl.[7] ..... F42B 7/02
(52) U.S. Cl. ..... 102/458; 102/449
(58) Field of Search ..... 102/448–453, 102/457, 458, 461–463, 501, 502, 522, 532

(56) References Cited

U.S. PATENT DOCUMENTS

| | | | |
|---|---|---|---|
| 618,901 | A | 2/1899 | Peterson et al. |
| 1,380,171 | A | 5/1921 | Abbot |
| 1,605,741 | A | 11/1926 | Jones |

(List continued on next page.)

FOREIGN PATENT DOCUMENTS

WO WO 94/23264 * 10/1994 ..... F42B/7/08

OTHER PUBLICATIONS

Ryan, Guns, Mortars & Rockets, 1982, Brassey Publishers Limited, pp. 47, 48 and 125.

Smith, Small Arms & Cannons, 1982, Brassey Publishers Limited, pp. 25 and 101.

U.S. patent application Ser. No. 09/923,272, Diller, filed Aug. 3, 2001.

U.S. patent application Ser. No. 10/219,024, filed Aug. 15, 2002.

U.S. patent application Ser. No. 09/592,475, filed Jun. 9, 2000.

*Primary Examiner*—Charles T. Jordan
*Assistant Examiner*—Kimberly S. Smith
(74) *Attorney, Agent, or Firm*—Vidas, Arrett & Steinkraus, P.A.

(57) ABSTRACT

A shotgun shell flight path indicator is described which in general includes a shell casing having a primer end having a primer, a propellant disposed within the interior of the casing proximate to the primer adapted for ignition by the primer, and a non-combustible indicator positioned within the casing. The indicator generally includes a base positioned proximate to the propellant where the base has a sufficient mass and size for unaided observation following discharge from a shotgun barrel. The indicator may include ballast integral to the base and pedals extending outwardly from the base to assist in aerodynamic drafting behind expelled shot to visually represent the flight trajectory of the expelled shot of a shotgun shell. The indicator may further include a plug disposed in the casing between the ballast and the propellant where the plug is adapted to compact the ballast within a ballast pocket integral to the base upon discharge of the shotgun shell to reduce peak barrel pressure for a shotgun.

15 Claims, 14 Drawing Sheets

U.S. PATENT DOCUMENTS

| | | | | | |
|---|---|---|---|---|---|
| 1,628,896 | A | | 5/1927 | Medearis | |
| 1,864,916 | A | | 6/1932 | Gachassin-Lafite | 102/449 |
| 2,512,850 | A | | 6/1950 | Crandall | |
| 2,742,821 | A | | 1/1956 | Sweetman | 42/76.01 |
| 2,842,024 | A | | 7/1958 | Mutter | |
| 2,916,970 | A | | 12/1959 | Mutter | |
| 3,405,638 | A | * | 10/1968 | Stoner, Jr. | 102/87 |
| 3,760,735 | A | | 9/1973 | Schmitt | 102/87 |
| 4,080,899 | A | * | 3/1978 | Luban | 102/42 R |
| 4,167,904 | A | * | 9/1979 | Ferri | 102/42 C |
| 4,546,564 | A | | 10/1985 | A'Costa | 42/76 |
| 4,553,481 | A | * | 11/1985 | Ricci | 102/458 |
| 4,722,261 | A | | 2/1988 | Titus | 89/7 |
| 4,841,866 | A | * | 6/1989 | Miesner | 102/458 |
| 5,272,827 | A | | 12/1993 | Vang et al. | 42/79 |
| 5,299,502 | A | | 4/1994 | Maki | 102/457 |
| 5,355,765 | A | | 10/1994 | Rogers | |
| 5,450,795 | A | * | 9/1995 | Adelman | 102/444 |
| 5,587,549 | A | | 12/1996 | Clouse | 89/14.3 |
| 5,844,162 | A | | 12/1998 | Renner | 89/14.3 |
| 6,065,384 | A | | 5/2000 | Widder et al. | 89/14.05 |
| 6,223,458 | B1 | | 5/2001 | Schwinkendorf et al. | 42/1.06 |

* cited by examiner

SHOTGUN SHELL FLIGHT PATH INDICATOR

The present invention is a divisional application and claims priority to U.S. patent application Ser. No. 10/219,024 filed Aug. 15, 2002, now U.S. Pat. No. 6,539,873, which is a continuation of U.S. patent application Ser. No. 09/592,475 filed Jun. 9, 2000, now abandoned, the entire contents all of which are incorporated herein by reference.

BACKGROUND

This invention relates to a shotgun shell having a flight path indicator for use in training sportsman and/or marksman for improved accuracy in striking moving targets.

In the past, untrained sportsman attempting to strike targets generally punch hole in the sky and accidentally hit a moving target. No feedback system and/or device is known which assists in the training of a sportsman attempting to strike a target as to whether a shot was high, low, in front of, or behind a moving target.

In sporting and/or training activities such as trap shooting, skeet shooting, sporting clays, and/or marksmanship practice, a sportsman would find it extremely helpful to visualize the flight path and/or trajectory of a shot at a moving target so that the sportsman could adjust his/her aim to hit moving targets more consistently and accurately.

In the past, tracer devices have been used in association with a shotgun shell where the tracers have included combustible materials and/or other pyrotechnic materials to attempt to visually approximate the path of shot expelled from a shotgun shell. The use of combustible devices frequently resulted in undesirable fires and/or fire hazards rendering use unsafe and impractical.

A need therefore exists for a non-combustible flight path indicator for use in a shotgun shell which accurately displays and/or follows the flight path of shotgun shot shell as discharged at a moving target.

Also, in the past, the combustible pyrotechnic tracer materials were costly to manufacture and incorporate into a standard shotgun shell casing. As a result, the use of combustible pyrotechnic tracers was uneconomical for use as a training aid for many marksmen.

No tracer is currently known which is non-combustible and which is readily observable by a sportsman for use as a training aid in target shooting.

In the past, a problem has existed with all tracers when used in targeting fast moving crossing objects. A sportsman and/or marksman in these instances has experienced difficulty determining whether a tracer has passed ahead of, or behind, an object such as a crossing clay. This problem generally involves an optical illusion where the eye follows the fast moving crossing target. Therefore, the tracer appears to arc left or right depending upon which direction the target is traveling. The tracer does not have an arcuate trajectory with the exception of loss of altitude due to gravity. Tracers used with fast moving crossing targets appear to indicate that the shot was slightly ahead of a target when, in fact, the shot was slightly behind the target. As best understood this problem results from the limitations of binocular vision which degrades in effectiveness beyond approximately 20 feet from an individual. Usually, a tracer is used with little or no reference points which are unavailable within a sky background. Therefore, the tracer appears to have traveled further and faster than is actually the case. The absence of reference points causes the tracer to appear to have passed ahead of a fast moving target when the tracer actually passed slightly behind the object. The tracer is never faster than the expelled shotgun projectiles.

To solve the binocular vision problem an observable non-combustible flight path indicator may be used. The non-combustible flight path indicator may have an adjustable flight path which varies depending upon the size of the indicator and/or the amount of ballast used within the indicator. An optically improved representation of a flight path may therefore be provided which more accurately reflects a true flight path for an expelled shotgun shell with respect to a fast moving crossing target.

Another problem with the tracers as known is the difficulty in observation of the tracers within the first 20 feet following discharge from a shotgun barrel. A need, therefore, exists to enhance visibility of the flight path indicator for observation by sportsmen/marksmen at the earliest opportunity following discharge from a shotgun shell.

Another problem with tracers as known is the difficulty in observation of the tracer in various atmospheric conditions such as glare, back light, and/or cloudy light. A need, therefore, exists to enhance visibility of the flight path indicator for observation by sportsmen/marksmen at the earliest opportunity within varying weather conditions.

In the past, simulators have been attempted to approximate the flight path of projectiles from a shotgun shell. The simulators as known generally completely fill a shotgun shell casing replacing the standard shot. A problem with these simulators was the inability to strike and break targets due to the low velocity and inaccuracy of the flight path simulating materials. A sportsman/marksman was therefore denied a desired system of training and/or feedback for visually observing the breaking of a target. The usefulness of the simulator devices was, therefore, extremely marginal.

SUMMARY

A principal advantage of the present invention is the provision of a shotgun shell having a flight path indicator which facilitates training and marksmanship of a sportsman.

Another principal advantage of the present invention is the provision of a shotgun shell having a flight path indicator which is formed of relatively simple and inexpensive design, construction, and operation which is safe, and which fulfills the intended purpose of enhancing marksmanship without risk of injury to persons and/or damage to property.

Still another principal advantage of the present invention is the provision of a shotgun shell having a flight path indicator which permits unaided observation by a sportsman to improve marksmanship.

Still another principal advantage of the present invention is the provision of a shotgun shell having a flight path indicator which provides immediate feedback to a sportsman for use as a marksmanship training aid.

Still another principal advantage of the present invention is the provision of a shotgun shell having a flight path indicator which accurately tracks the flight path of expelled shot from a shotgun shell and shotgun barrel.

Still another principal advantage of the present invention is the provision of a shotgun shell having a flight path indicator which minimizes human errors in the perception of the flight path of the indicator and/or shot which occur as a result of optical illusions of binocular vision when attempting to strike fast moving crossing targets.

Still another principal advantage of the present invention is the provision of a shotgun shell having a flight path indicator which utilizes non-combustible materials which in turn eliminates risk of accidental fires.

Still another principal advantage of the present invention is the provision of a shotgun shell having a flight path indicator which is adapted for use within a standard shotgun shell casing and which further is used in conjunction with shotgun shell shot used to break targets during shooting activities.

Still another principal advantage of the present invention is the provision of a shotgun shell having a flight path indicator which drafts behind expelled shot of a shotgun shell to accurately reflect the trajectory of the discharged shot.

Still another principal advantage of the present invention is the provision of a shotgun shell having a flight path indicator which is economical for use in shotgun shells as a training aid for sportsmen.

Still another principal advantage of the present invention is the provision of a shotgun shell having a flight path indicator which is flexible and may be configured to have a faster or slower air velocity for a desired level of observation by a sportsman dependent upon the level of marksmanship or training and/or the type of shooting activities to be attempted by the individual.

Still another principal advantage of the present invention is the provision of a shotgun shell having a flight path indicator which is reliable and accurate and which is easily observable to represent the flight trajectory of expelled shot from a shotgun shell.

Still another principal advantage of the present invention is the provision of a shotgun shell having a flight path indicator which provides easy, unaided or unassisted observation by sportsmen during use in a variety of climate conditions.

Still another principal object of the present invention is the provision of a shotgun shell flight path indicator which in one embodiment functions similar to a badminton birdie following discharge from a shotgun shell barrel to rotate approximately 180° to draft behind expelled shot.

Still another principal advantage of the present invention is the provision of a shotgun shell having a flight path indicator which is flexible having varying aerodynamic properties to maximize unaided observation at specific target ranges and distances.

Still another principal advantage of the present invention is the provision of a shotgun shell having a flight path indicator which protects the bore of a shotgun shell barrel from scrubbing by expelled pellets from a shotgun shell.

Still another principal advantage of the present invention is the provision of a shotgun shell having a flight path indicator which acts to cushion pellets during acceleration immediately following the discharge of the shotgun shell.

Still another principal advantage of the present invention is the provision of a shotgun shell having a flight path indicator which reduces peak barrel pressure during the discharge of a shotgun shell.

Still another principal advantage of the present invention is the provision of a shotgun shell having a flight path indicator which is spatially efficient within a shotgun shell casing partially occupying the interior of the shotgun shell casing to enable the shotgun shell to include shot.

Still another principal advantage of the present invention is the provision of a shotgun shell having a flight path indicator which appears to pass through a fast moving crossing target as the target is broken by the shot discharged from the shotgun shell.

A feature of the shotgun shell having a flight path indicator is the provision of a shotgun shell casing having a primer end and an ignition primer adapted to hold propellant and a non-combustible indicator which, when expelled, visually represents the trajectory of the discharged shot from the shotgun shell.

Another feature of one embodiment of the shotgun shell having a flight path indicator is the provision of an indicator positioned proximate to the propellant within the shotgun shell casing.

Still another feature of one embodiment of the shotgun shell having a flight path indicator is the provision of an indicator having a sufficient mass and size to accurately follow the trajectory of expelled shot from a shotgun shell and which is further easily visualized without optical aids by a sportsman.

Still another feature of one embodiment of the shotgun shell having a flight path indicator is the provision of an indicator having ballast integral or affixed to the indicator to assist in the provision of an accurate or desired trajectory for the indicator with respect to the expelled shot of a shotgun shell.

Still another feature of one embodiment of the shotgun shell having a flight path indicator is the provision of an indicator which includes one or more petals, wings or stabilizers extending outwardly from a base to assist in the aerodynamic drafting of the indicator behind the expelled shot which further facilitates the unaided visualization of the indicator following discharge of the shotgun shell.

Still another feature of one embodiment of the shotgun shell having a flight path indicator is the provision of an indicator having one or more pivotal petals, wings or stabilizers extending outwardly from a base which assist in the provision of an accurate or desired trajectory for the indicator with respect to the expelled shot of a shotgun shell.

Still another feature of one embodiment of the shotgun shell having a flight path indicator is the provision of an indicator having a plug disposed in the casing between the ballast and the propellant where the plug is adapted to compact the ballast within a ballast pocket upon the discharge of the shotgun shell.

Still another feature of one embodiment of the shotgun shell having a flight path indicator is the provision of an indicator having a ballast pocket adapted to hold ballast prior to, during, and following the discharge of a shotgun shell by a sportsman during shooting activities.

Still another feature of one embodiment of the shotgun shell having a flight path indicator is the flexibility of use of the indicator with or without a compression wad within a shotgun shell casing.

Still another feature of one embodiment of the shotgun shell having a flight path indicator is the flexibility of use of the indicator with or without a gas seal within the shotgun shell casing.

Still another feature of one embodiment of the shotgun shell having a flight path indicator is the flexibility of use of the indicator with or without wings, stabilizers, and/or petals for unaided observation by an individual.

Still another feature of one embodiment of the shotgun shell having a flight path indicator is the provision of an indicator which has a velocity which is approximately the same as the shot cloud of an expelled shotgun shell for a distance of 40 yards.

Still another feature of one embodiment of the shotgun shell having a flight path indicator is the provision of an indicator which has a maximum range of approximately 150 yards.

Still another feature of one embodiment of the shotgun shell having a flight path indicator relates to the performance of the indicator which may function both as a trajectory indicator and as a compression wad for a shotgun shell.

Still another feature of one embodiment of the shotgun shell having a flight path indicator is the performance of the indicator which may seal hot gasses within the casing and barrel of a shotgun, where the hot gasses occur upon the combustion of powder ignited by the primer within the shotgun shell casing.

Still another feature of one embodiment of the shotgun shell having a flight path indicator is the positioning of the ballast which may cause the indicator to rotate 180° in flight following discharge from a shotgun barrel.

Still another feature of one embodiment of the shotgun shell having a flight path indicator is the forcing of the plug into the partially empty ballast pocket to cushion the ballast and shotgun pellets to reduce peak barrel pressure upon a shotgun.

Still another feature of one embodiment of the shotgun shell having a flight path indicator is the folding movement of the petals, wings or stabilizers backwardly in flight to increase and/or enlarge the visible area of the indicator to enhance unaided observation by an individual.

Still another feature of the shotgun shell flight path indicator is the spring tension selected for the petals, wings or stabilizers which may alter the aerodynamics and trajectory of the indicator in flight.

Still another feature of one embodiment of the shotgun shell having a flight path indicator is the mass elected for the ballast weight which may alter the aerodynamics and trajectory for the indicator to optimize the visibility and apparent speed of the indicator in the vicinity of a target.

Still another feature of one embodiment of the shotgun shell having a flight path indicator are the petals, wings or stabilizers which function in a manner similar to feathers or fletching of an arrow, causing the indicator to rotate in flight improving the aerodynamic efficiency of the indicator towards a target.

Still another feature of one embodiment of the shotgun shell having a flight path indicator is the flexibility of the indicator where ballast is not essential to the performance and visualization of the indicator following discharge from a shotgun barrel.

Still another feature of one embodiment of the shotgun shell having a flight path indicator is the provision of an indicator which is colored to enhance unaided visualization in varying environmental conditions.

Still another feature of one embodiment of the shotgun shell having a flight path indicator is the provision of one or more petals, wings or stabilizers where each petal has a hinge proximate to a base.

Still another feature of one embodiment of the shotgun shell having a flight path indicator is the provision of an indicator where the ballast is integral to the indicator.

Still another feature of one embodiment of the shotgun shell having a flight path indicator is the provision of an indicator or base which is spherical in shape.

Still another feature of one embodiment of the shotgun shell having a flight path indicator is the provision of a cylindrical shot protector adjacent to the indicator to assist in the protection of the bore of the shotgun barrel from scrubbing by the expelled shotgun shell shot.

Still another feature of one embodiment of the shotgun shell having a flight path indicator is the provision of one or more petals, wings or stabilizers having a first at rest position and a second flight position to improve unaided observation and the aerodynamic trajectory of the indicator following discharge of the shotgun shell.

Still another feature of one embodiment of the shotgun shell having a flight path indicator is the provision of a base having a ballast pocket defined by a bridge and an opening opposite to the bridge where the ballast pocket is adapted to hold a desired amount of ballast for the indicator.

Still another feature of one embodiment of the shotgun shell having a flight path indicator is the provision of an indicator having a first compression member positioned between the base and the ballast to assist in reducing peak barrel pressure during discharge of a shotgun shell and use of the indicator.

Still another feature of one embodiment of the shotgun shell having a flight path indicator is the provision of a first compression member having a platform positioned opposite to the base, where the petals, wings or stabilizers are engaged to the platform.

Still another feature of one embodiment of the shotgun shell having a flight path indicator is the provision of a support engaged to the platform interior to the petals, wings or stabilizers where the support includes a second compression member and where the ballast is engaged to the support.

Still another feature of one embodiment of the shotgun shell having a flight path indicator is the provision of a base having a recessed cavity proximate to the propellant.

Still another feature of one embodiment of the shotgun shell having a flight path indicator is the provision of a first compression member having a plurality of support ribs.

Still another feature of one embodiment of the shotgun shell having a flight path indicator is the provision of a base having an expansible support wall having a gas seal which is positioned proximate to the propellant.

Still another feature of one embodiment of the shotgun shell having a flight path indicator is the provision of a ballast support traversing the expansible support wall.

Still another feature of one embodiment of the shotgun shell having a flight path indicator is the provision of a first ledge traversing the expansible support wall opposite to the ballast support where the first ledge has a central opening providing access into a pocket located between the first ledge, the expansible support wall, and the ballast support.

Still another feature of one embodiment of the shotgun shell having a flight path indicator is the provision of slow activating powder disposed in the pocket where ignition of the slow activating powder causes the expansion of the expansible support wall to enlarge the indicator to facilitate unaided observation by a sportsman.

Still another feature of one embodiment of the shotgun shell having a flight path indicator is the provision of a base having a plurality of support beams terminating in a second ledge adapted to hold the ballast.

Still another feature of one embodiment of the shotgun shell having a flight path indicator is the provision of a breakaway shot protector adapted to hold shot and separate from the indicator following discharge from the barrel of a shotgun.

DETAILED DESCRIPTION OF THE PREFERRED EMBODIMENT

Figure 1:
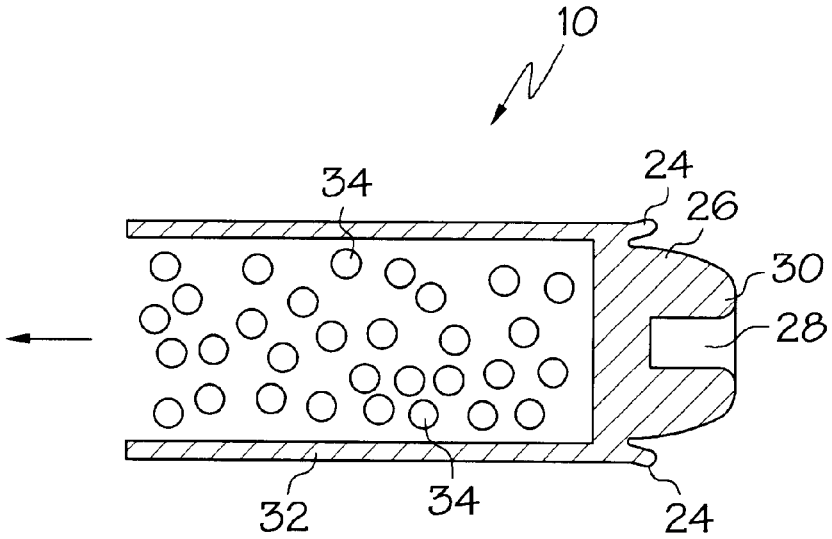
FIG. 1 is a cross-sectional side view of the indicator holding shot.

In general, the shotgun shell having a flight path indicator is identified by the numeral 10. The shotgun shell having a flight path indicator 10 is preferably positioned within a shotgun shell 12 which generally includes a casing 14 and an ignition primer end 16 having an ignition primer 18. Within the interior of the casing 14 is preferably positioned propellant 20 which may be gun powder which is located adjacent to the primer 18. A compression wad 22 is preferably disposed adjacent to the propellant 20. The compression wad 22 may include gas seals 24 to facilitate discharge of projectiles during ignition of the propellant 20.

In general, the shotgun shell having a flight path indicator 10 is formed of an indicator 26 having ballast or weight 28 which is disposed within the interior of the casing 14 adjacent to the compression wad 22.

Referring to FIG. 1, the general concept of the shotgun shell having a flight path indicator 10 is indicated. In this embodiment the shotgun shell having a flight path indicator 10 is formed of non-combustible materials and generally includes a cylindrical indicator or base 26 adapted for positioning within the casing 14 of a shotgun shell 12. The cylindrical indicator 26 preferably includes a gas seal 24 and an internal pocket 30 which is adapted to securely receive and hold ballast or weight 28. The indicator 26 preferably includes a longitudinally extending cylindrical wall 32 which is preferably adapted for holding a plurality of projectiles or shot 34. It should be noted that the longitudinally extending cylindrical wall 32 has an open end permitting the discharge of shot 34 from a shotgun shell 12 following the ignition of the propellant 20 by the ignition primer 18.

Upon the discharge of the shotgun shell 12 including the shotgun shell having a flight path indicator 10, the indicator 26 will be expelled from a shotgun barrel with the open end of the longitudinally extending cylindrical wall 32 proximate to the shot 34. As air resistance and aerodynamic forces impact the open end of the longitudinally extending cylindrical wall 32, the indicator 26 will rotate approximately 180° such that the indicator 26 having the ballast 28 will be proximate to the cloud of shot 34 along a common trajectory. The shotgun shell having a flight path indicator 10 preferably rotates 180° in flight due to the center of gravity for the indicator 26 being unstable when the open end of the longitudinal extending cylindrical wall 32 is exposed to air resistance and aerodynamic force. The shotgun shell having a flight path indicator 10 and the indicator 26 may be preferably colored a dark color such as black to facilitate observation against a light background such as a sky by a sportsman during training activities without the aid of optical devices or enhancers. The shotgun shell having a flight path indicator 10 formed of the indicator or base 26 and the longitudinally extending cylindrical wall 32 is preferably of a sufficient size to be visible by a sportsman without the aid of optical devices. It should be noted that during use that the shotgun shell having a flight path indicator 10 preferably approximates the flight path of the expelled shotgun shot 34 through a combination of aerodynamic forces and drafting where the total mass and size of the indicator 26 accurately reflect the trajectory of the expelled shot 34.

The indicator 26 is preferably formed of injected molded plastics. However, any other suitable material may be utilized by an individual including, but not limited, to the use of rubber, wood, soft metal, and/or hard metal, at the discretion of an individual provided that the essential functions, features, and attributes described herein are not sacrificed.

In the embodiment as depicted in FIG. 1, the indicator 26 in flight preferably operates in a manner similar to a badminton birdie following expulsion from a shotgun barrel to rotate approximately 180° to draft behind the expelled shot 34. The longitudinally extending cylindrical wall 32 preferably assists in the protection of the interior of a shotgun barrel from scrubbing which occurs by expelled shot 34 from a shotgun shell 12. The dimensions selected for the longitudinally extending cylindrical wall 32 are sufficiently short to fit within the standard casing 14 of a shotgun shell 12. The indicator 26 as depicted herein is specifically designed to hold shot 34 which may be utilized by a marksman to break a target during training activities.

The indicator or base 26, and longitudinally extending cylindrical walls 32 preferably have a sufficient size and mass to accurately follow the trajectory of expelled shot 34 from a shotgun shell 12 for visualization by a sportsman without the necessity of use of optical aids.

The ballast 28 as depicted in FIG. 1 is not required to be integral to the interior of the indicator 26. The ballast 28 and/or weight may be affixed or secured to the exterior of the indicator 26 at the preference of an individual.

The size and amount of ballast 28 and/or weight utilized may vary considerably dependant upon the desired trajectory for the shotgun shell having a flight path indicator 10. The size of the ballast 28 may be enlarged or reduced for use of the indicator 26 with fast moving crossing targets such as skeet. Alternatively, the size and mass of the ballast 28 may be altered for use by a sportsman in targeting sporting clays. The variation of the size and weight of the ballast 28 alters the trajectory of the indicator 26 as tracking the trajectory of shot 34 discharged from a shotgun shell 12. As such, an individual may adjust the amount of ballast 28 to compensate for optical illusions which occur as a result of binocular vision when targeting fast moving crossing objects such as skeet. The selection of a preferred weight or mass for the ballast 28 may therefore provide the appearance of the indicator 26 passing directly through a fast moving crossing target such as a skeet eliminating the optical illusion that the indicator 26 passed ahead of the target when in fact the indicator 26 passed slightly behind the target.

The shotgun shell having a flight path indicators 10 described herein may be used with or without a compression wad 22 at the discretion of an individual. As depicted in FIG. 1, the indicator 26 may include gas seals 24 and may function in the same capacity as a compression wad 22. A compression wad 22 may therefore be eliminated from the interior of the shotgun shell 12 at the preference of an individual. The use of a gas seal 24 as integral to a compression wad 22 may also be eliminated due to the provision of a gas seal 24 as integral to the indicator 26. In this embodiment the indicator 26 performs a dual function as a trajectory indicator for shot 34 and as a compression wad 22 for a shotgun shell 12. Further, the indicator 26 may function as a gas seal 24 to contain hot gasses within the casing 14 and barrel of a shotgun which occur following the combustion of the propellant 20 as ignited by the primer 18.

The mass of the ballast 28 may be selected by an individual to alter the aerodynamics and trajectory for the indicator 26 to optimize the visibility and the apparent speed of the indicator 26 in the vicinity of a moving target. Alternatively, the inclusion of ballast 28 within the indicator 26 is not essential to the performance and visualization of the indicator 26 following discharge from a shotgun barrel. If the indicator 26 has sufficient size and mass, the indicator 26 will enable visualization by a sportsman without the aid of optical devices.

Figure 2:
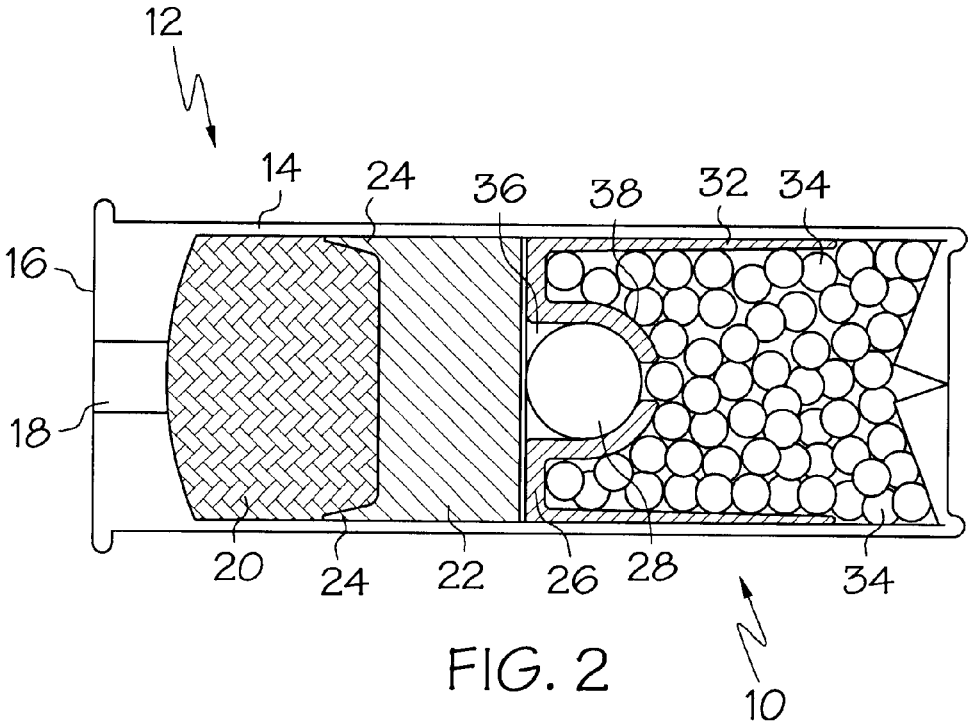
FIG. 2 is a cross-sectional side view of a shotgun shell and indicator.

As may be seen in FIG. 2 the shotgun shell 12, casing 14, primer end 16, ignition primer 18, propellant 20, compression wad 22, and gas seals 24 are depicted as standard items of the shotgun shell 12. The indicator 26 preferably includes a longitudinally extending cylindrical wall 32. The indicator 26 may include a cup-shaped pocket 36 which is preferably adapted to securely receive and affix ballast 28 to the indicator 26. The cup shaped pocket 36 may include grasping members 38 or be a one piece integral unit at the preference of an individual provided that the ballast 28 is securely attached to the indicator 26 to prevent separation therefrom during and following the discharge of the shotgun shell 12. The ballast 28 as positioned within and affixed to the cup shaped pocket 36 preferably remains attached following expulsion from a shotgun barrel for the provision of an accurate visual representation of the flight trajectory for expelled shot 34.

Figure 3:
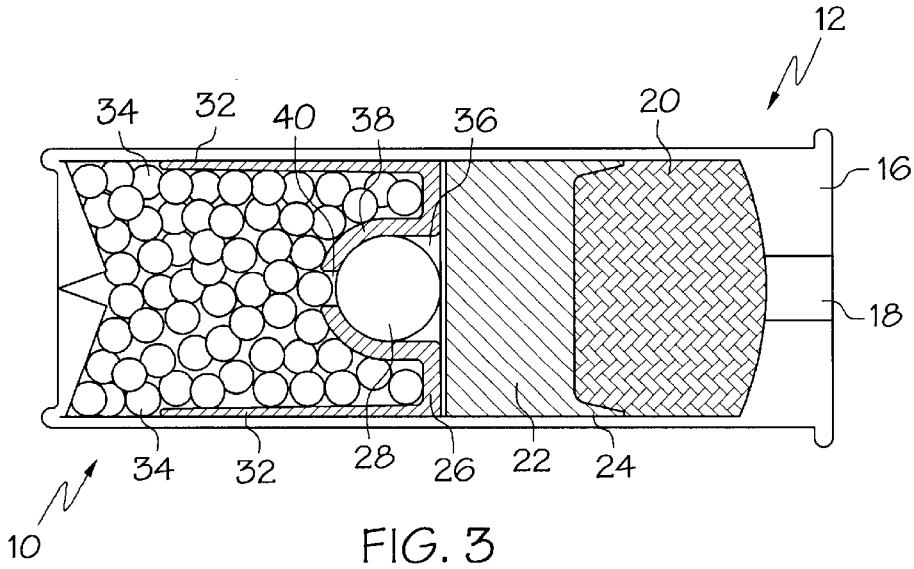
FIG. 3 is a cross-sectional side view of a shotgun shell and indicator.
Figure 4:
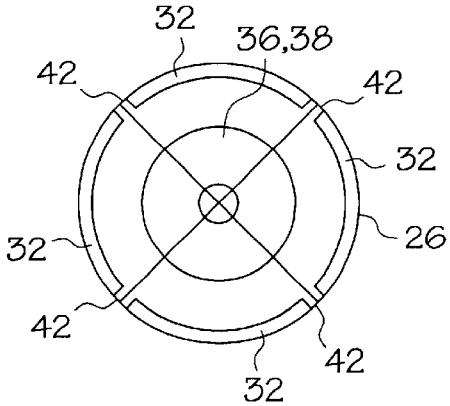
FIG. 4 is a top view of the indicator.

Referring to FIGS. 3 and 4, an alternative shotgun shell having a flight path indicator 10 is depicted. In this embodiment the cup-shaped pocket 36 and graspers 38 preferably include a central opening 40. Particularly with reference to FIG. 4, the longitudinally extending cylindrical wall 32 preferably is divided into four equally spaced sections having a longitudinal slot 42 positioned between adjacent sections. A longitudinal slot 42 between adjacent sections of the longitudinally extending cylindrical wall 32 enable individual sections of the cylindrical wall 32 to slightly bend when exposed to aerodynamic forces to facilitate the trajectory of the indicator 26 to accurately reflect the flight path of the shot 34 as expelled from a shotgun. In addition, the longitudinal slot 42 assists in the rotation of the indicator 10 approximately 180° immediately following discharge from a shotgun barrel for positioning of the ballast 28 forwardly during flight to reflect the trajectory of the expelled shot 34.

Figure 5:
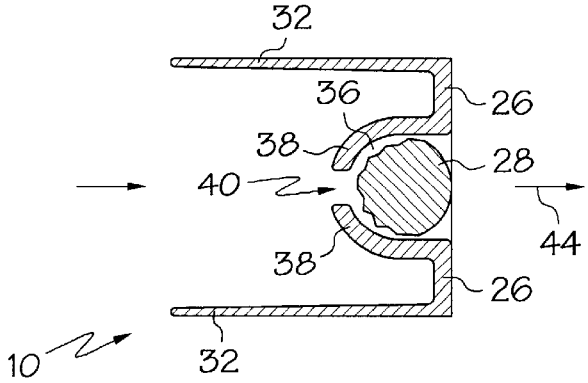
FIG. 5 is a detail cross-sectional side view of the indicator expelled from a shotgun.

The indicator 26 depicted at FIG. 5 shows the direction of flight for the indicator 26 following discharge from a shotgun barrel following rotation of 180°. The direction of flight for the indicator 26 following rotation is indicated by arrow 44 where the open end of the longitudinal extending cylindrical wall 32 is rearwardly towards a sportsman and the ballast 28 is the leading edge of the indicator 26.

Figure 6:
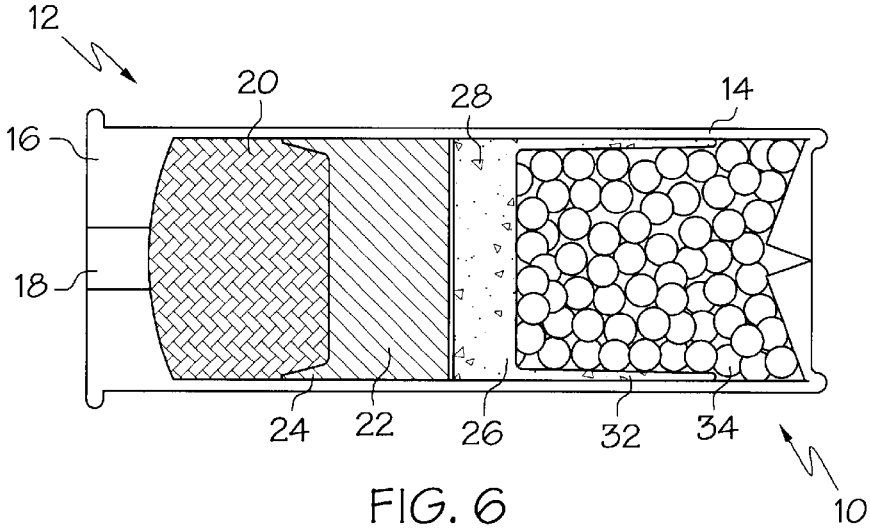
FIG. 6 is an alternative cross-sectional side view of a shotgun shell and indicator.

As depicted in FIG. 6 the ballast 28 may be dispersed within the indicator 26. Following discharge from a shotgun the indicator 26 as depicted in FIG. 6 may also rotate approximately 180° positioning the indicator 26 and ballast 28 forwardly for representation of the flight trajectory for the expelled shot 34.

Figure 7:
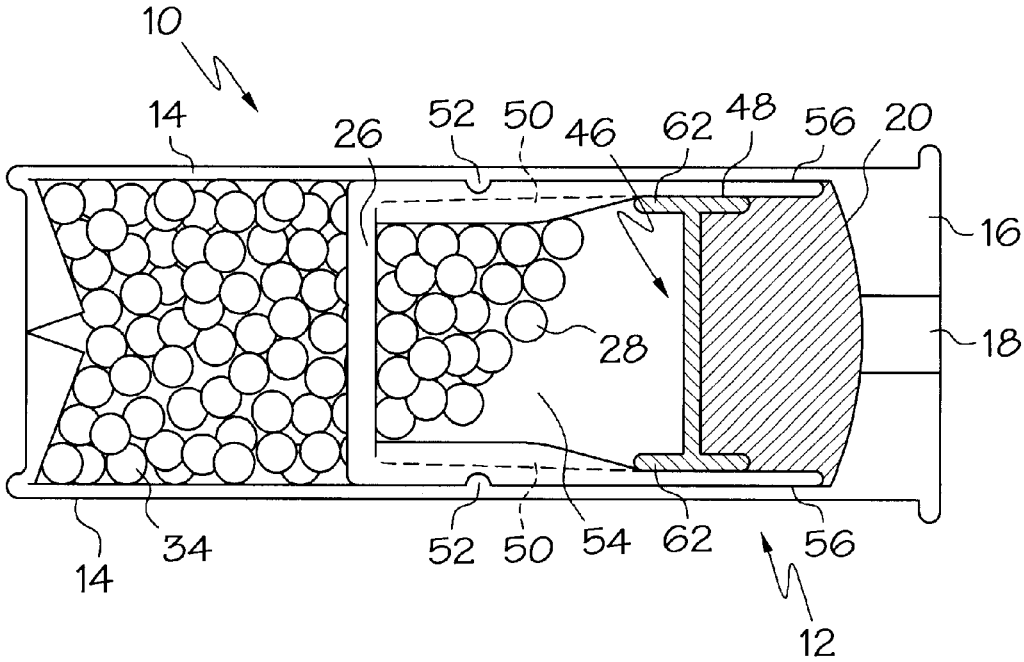
FIG. 7 is an alternative cross-sectional side view of a shotgun shell and indicator.
Figure 8:
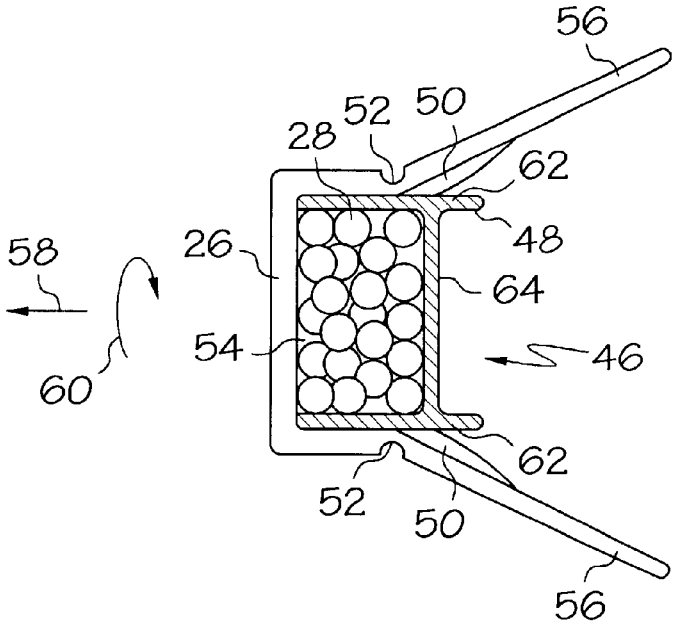
FIG. 8 is a detail cross-sectional side view of the indicator of FIG. 7 as expelled from a shotgun.

An alternative embodiment of the indicator 26 is depicted in FIGS. 7 and 8. In this embodiment the compression wad 22 is replaced by a plug 46 having gas seals 48 adjacent to the propellant 20. In this embodiment the indicator 26 preferably includes expansible wing members or petals 56. Spring members 50 preferably extend between the indicator 26 and the expansible wing members 56 for urging the expansible wing members 56 outwardly to a flight position as indicated in FIG. 8. The junction between the expansible wing members 56 and the indicator 26 is preferably a hinge 52. Interior to the indicator 26 is preferably a ballast pocket 54 which includes ballast 28. It should be noted as depicted in FIG. 7 that the ballast pocket 54 is not completely filled with ballast 28 prior to the discharge of the shotgun shell 12.

During assembly, the expansible wing members 56 are manipulated inwardly to compress the spring members 50 and expand the hinge 52 to permit positioning to the interior of the casing 14 of the shotgun shell 12.

Upon discharge of the shotgun shell 12, the propellant 20 is ignited causing the plug 46 to move forwardly into the ballast pocket 54 to compress and hold the ballast 28 against the indicator 26. As the indicator 26 is then expelled from the shotgun barrel the spring members 50 expand and the hinge 52 contracts permitting the expansible wing members 56 to move outwardly into a flight position. In this regard, the plug 46 has a triple function of first acting as a compression wad 22, second acting as a gas seal 24, and third the plug 46 functions to compact the ballast 28 forwardly within the ballast pocket 54. The partial filling of the ballast pocket 54 with ballast 28 permits the forward expansion of the plug 46 to cushion the discharge of the shotgun shell 12 which in turn reduces maximum barrel pressure as exposed to the barrel of a shotgun. The resiliency selected for the spring members 50 and hinge 52 in conjunction with the length and flexibility of the expansible wing members 56 provide for the adjustable trajectory of the indicator 26 as desired by an individual. It should be noted that in the embodiment as depicted in FIGS. 7 and 8, the indicator 26 does not rotate 180° similar to a badminton birdie. In this embodiment, the indicator 26 continues in one direction where the expansible wing members 56 provide for the desired aerodynamic configuration to accurately reflect the trajectory of the expelled shot 34. It should be noted that the outward manipulation of the expansible wing members 56 also enlarges the size of the indicator 26 to facilitate the ease of unaided observation by a sportsman during shooting activities. In this embodiment, the plug 46 preferably performs all the functions of a traditional shotgun compression wad 22. Further, in this embodiment the plug 46 also preferably performs all the functions of a standard gas seal 24.

During ignition of the propellant 20 by ignition of the primer 18, the plug 46 is forced forwardly into the partially empty ballast pocket 54 to cushion the shot 34 and to reduce peak barrel pressure upon the shotgun barrel. In addition, the outward positioning of the expansible wing members 56 may also cause the indicator 26 to rotate about an axis 58 as depicted by arrow 60 similar in operation to the rotation provided to an arrow by the fletching and/or feathers. The accuracy of the rotating indicator 26 to reflect the true flight trajectory of the shot 34 is thereby improved.

Further, the use of expansible wing members 56 may also assist in the aerodynamic drafting of the indicator 26 behind the expelled shot 34 which further facilitates the unaided visual observation of the indicator 26 following discharge from a shotgun barrel.

The plug 46 may have a cross-sectional shape resembling an H. However, the plug 46 is preferably substantially cylindrical having a cylindrical band 62 and a centrally positioned disc 64 positioned approximately equal distances between the opposite ends of the cylindrical band 62. It should be noted that the plug 46 may have other shapes or configurations as preferred by an individual provided that the essential functions, features and attributes described herein are not sacrificed.

Figure 9:
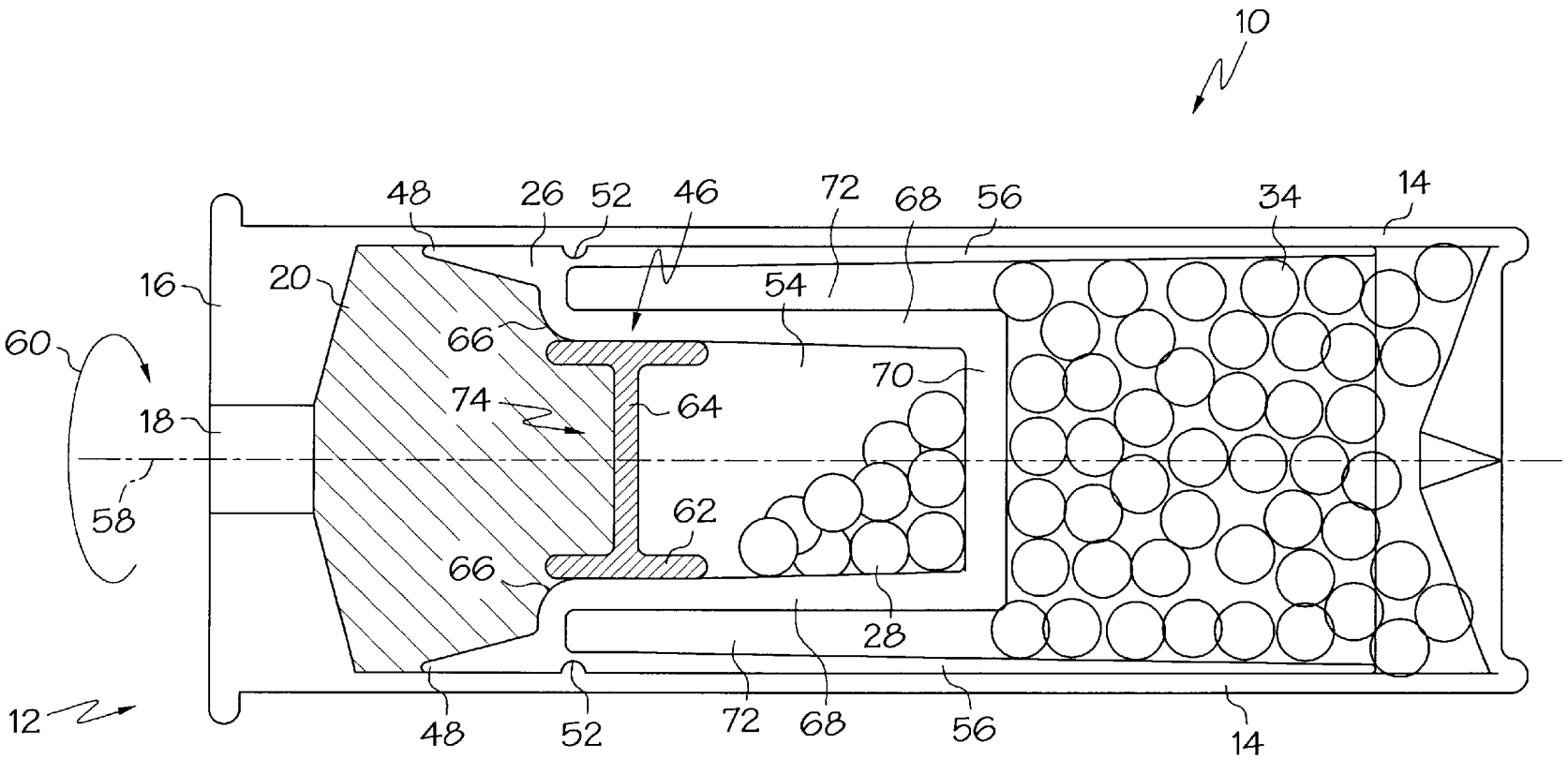
FIG. 9 is an alternative cross-sectional side view of a shotgun shell and indicator.
Figure 11:
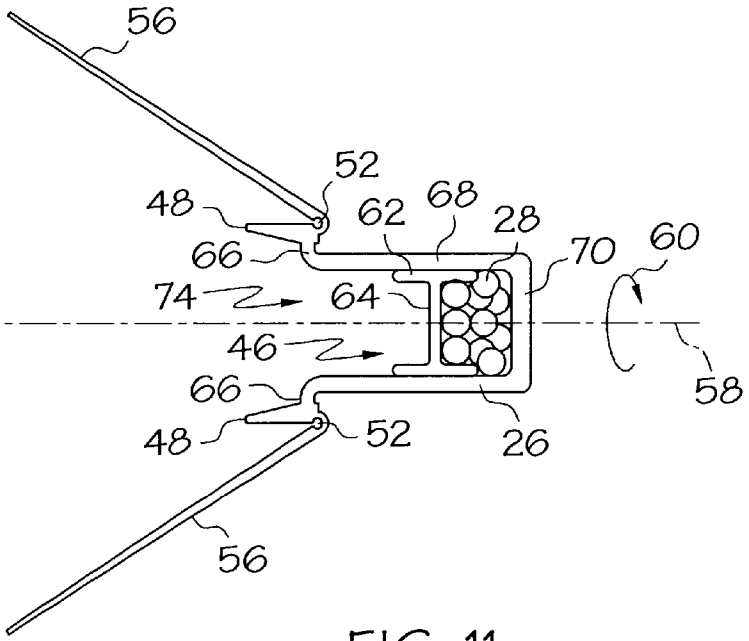
FIG. 11 is a detail cross-sectional side view of the indicator of FIG. 10 as expelled from a shotgun.
Figure 10:
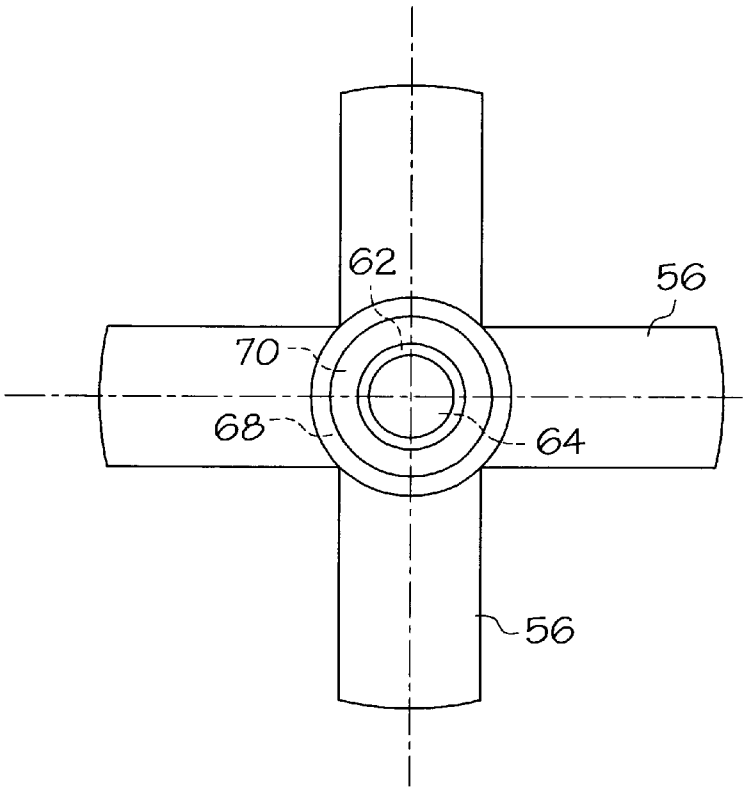
FIG. 10 is a detail rear view of the indicator of FIG. 9.

An alternative embodiment is depicted in FIGS. 9–15 which shows an indicator 26 having gas seals 48, wings, stabilizers, and/or petals 56, and a ballast pocket 54 closed by a plug 46'. In detail, the indicator 26 has gas seals 48 proximate to the propellant 20 in sealing relationship thereto. The indicator 26 adjacent to the gas seals 48 may have a cylindrical shoulder 66 which is connected to a cylindrical frame 68. The cylindrical frame terminates in a disc shaped bridge 70. Opposite to the bridge 70 is preferably an opening 74 which provides access into the ballast pocket 54. Within the ballast pocket 54 is preferably disposed ballast 28 which may not entirely fill the ballast pocket 54. Alternatively, an individual may completely fill the ballast pocket 54 with ballast 28 at the individuals discretion. The plug 46 is basically cylindrical in shape having a cylindrical band 62 and a centrally positioned disc 64 as earlier described. It should be noted that the plug 64 preferably has an at rest position traversing the opening 74 as depicted in FIG. 9. In addition, the plug 46 has an operational position as represented in FIG. 11 where the plug 46 has moved forwardly to compact ballast 28 within the ballast pocket 54 where the plug 46 is positioned proximate to the bridge 70 during flight of the indicator 26 following discharge of the shotgun shell 12.

Extending outwardly from the indicator 26 proximate to the hinge 52 are preferably a plurality of wings, stabilizers, and/or petals 56 which are adjacent to the interior of the casing 14 of the shotgun shell 12. The petals 56 are preferably separated from the frame 68 defining an internal cavity 72. The length of the petals 56 may vary at the discretion of an individual and may extend longitudinally the entire length of the casing 14 at the preference of an individual. Alternatively, the length dimension selected for the petals 56 may be significantly shorter at the discretion of an individual dependent upon the type of trajectory desired for the indicator 26 and the speed and distance the indicator 26 is to travel in representation of the trajectory of expelled shot 34 from a shotgun shell 12.

Specifically referring to FIG. 11, the indicator 26 is depicted following discharge from a shotgun shell 12 and shotgun shell barrel. It should be noted that in this embodiment the indicator 26 does not rotate 180° and continues with the original configuration with the exception of the rearward folding of the petals 56 and the compaction of the plug 46 within the ballast pocket 54. The discharge of the shotgun shell 12 having the indicator 26 as depicted in FIG. 9 immediately causes the propellant 20 to explosively expand the plug 46 forwardly into the ballast pocket 54 compacting the ballast 28 against the interior of the bridge 70. The forward actuation of the plug 46 assists in the provision of cushioning for the shotgun shell 12 and further assists to reduce peak barrel pressure exposed to a shotgun barrel. The discharge of the propellant 20 causes the indicator 26 as depicted in FIG. 9 to move forwardly out of the shotgun shell casing 14. The petals 56 then are positioned adjacent to the interior of the shotgun shell barrel during discharge. The petals 56 while adjacent to the interior surface of the bore of the shotgun shell barrel assist in the reduction of scrubbing which occurs between the shot 34 and the bore. Following discharge of the indicator 26 from the shotgun shell barrel, air resistance will encounter the forward edge of the petals 56 and air will enter into the cavity 72. The velocity of the indicator 26 is of sufficient magnitude to immediately cause the petals 56 to fold backwardly via the hinge 52 to a second in flight position 78 as represented in FIG. 11. The position of the petals 56 prior to discharge from a shotgun may be identified as the first at rest position 76 as depicted in FIG. 9.

The shape and dimensions selected for the petals 56 provide for alternative aerodynamic characteristics for the indicator 26 permitting an individual to adjust a desired trajectory during flight. In addition, the petals 56 preferably function in a manner similar to fletching or feathers for an arrow causing the rotation of the flight of the indicator 26 as depicted by arrow 60 about an axis 58 for rendition of a more accurate flight trajectory in representation of the flight path of shot 34 expelled from a shotgun. In addition, the positioning of the petals 56 rearwardly in the second flight position 78 in conjunction with the gas seals 48 and opening 74, assist in the drafting effect of the indicator 26 following the fast moving shot 34 as discharged from a shotgun. The rearward positioning of the petals 56 to the second flight position 78 also preferably increases the visible area of the indicator 26 to promote unaided observation by a sportsman. The tension of the hinge 52 may be varied at the discretion of an individual to alter or modify the aerodynamic characteristics of the indicator 26 during flight. The tension of the hinge 52 may be increased or decreased by increasing or decreasing the diameter between the hinge 52 and the cavity 72. A thicker dimension of material between the hinge 52 and cavity 72 provides increased tension which in turn increases the aerodynamic drag characteristics and increases the observable size of the indicator 26 and reduces the velocity of the indicator 26 during flight. Alternatively, a reduced thickness dimension for the hinge 52 will, in turn, reduce the tension of the petals 56 for provision of a flatter more streamlined indicator 26 which will facilitate the maximization of speed and distance for the indicator 26 during flight. The increase in speed and distance reduces the observable size of the indicator 26. It should be noted that the amount of ballast 28 selected to be disposed in the ballast pocket 54 may be varied to facilitate a desired type of trajectory. The tension of the hinge 52 and size and shape of the petals 56 may also be varied to facilitate a desired type of trajectory for the indicator 26. Therefore, an indicator 26 may have a desired speed and distance for optimization of unaided visibility in varying environmental conditions or during different types of sporting activities. The modifications implemented to the variables for the tension of the hinge 52, the size and shape of the petals 56, and the amount of ballast 28 may, in combination, be selected to accurately reflect the trajectory of the indicator 26 to coincide with the flight of shot 34 in the vicinity of a target. Further, it should be noted that the amount or volume of propellant 20 may be increased or decreased to provide for increased and/or decreased velocity for the indicator 26 and shot 34 following discharge of the shotgun shell 12. A light or heavy load for the shotgun shell 12 may thereby be provided.

The initial separation of the plug 46 within the opening 74 from the ballast 28 preferably assists to cushion the acceleration of the shot 34 following discharge of the shotgun shell 12. This cushioning of acceleration of the shot 34 assists in the reduction of peak barrel pressure forces exposed to the barrel of a shotgun during discharge of a shotgun shell 12.

The number of petals 56 selected for the indicator 26 may vary at the discretion of an individual. It is envisioned that at least two petals 56 will be provided. However, any number of petals may be selected as desired where it is anticipated that the number of petals is preferably between two and five in number for optimization of performance of the indicator 26.

Figure 12:
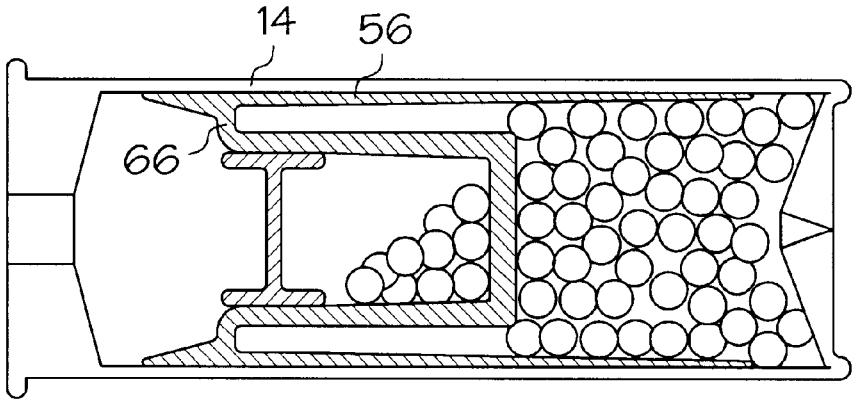
FIG. 12 is an alternative cross-sectional side view of a shotgun shell and indicator.
Figure 13:
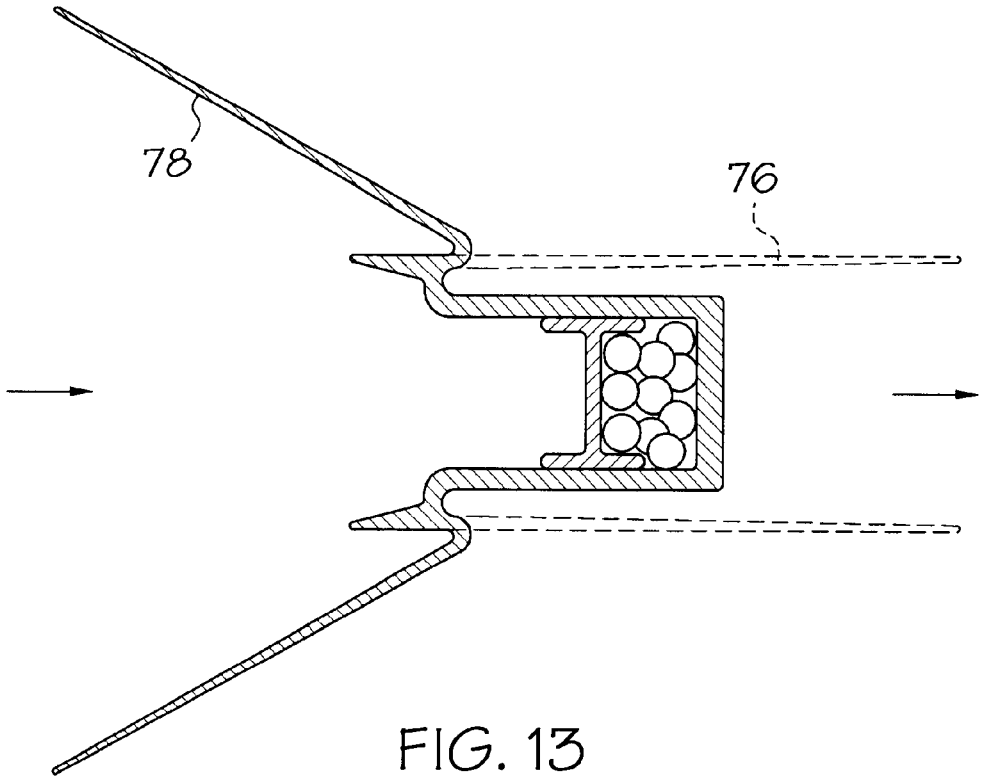
FIG. 13 is a detail partial phantom line cross-sectional side view of the indicator of FIG. 12 as expelled from a shotgun.

Referring to FIGS. 12 and 13, an alternative embodiment of the indicator 26 is depicted. In the embodiment of indicator 26 shown in FIGS. 12 and 13, the hinge 52 has been eliminated between the petals 56 and the shoulder 66. In this embodiment the air resistance and/or aerodynamic forces exposed to the petals 56 following discharge from a shotgun shell barrel cause the petals 56 to fold backward from the first at rest position indicated by the numeral 76 in FIG. 13 to the folded second flight position as indicated by the reference numeral 78 in FIG. 13. In FIGS. 12 and 13 the tension selected for the rearwardly folding petals 56 may be increased or decreased by adjusting the thickness of the petals 56 adjacent to the shoulder 66. Preferably a sufficient thickness dimension is selected for the petals 56 adjacent to the shoulder 66 to prevent fracture and/or separation therefrom.

Figure 14:
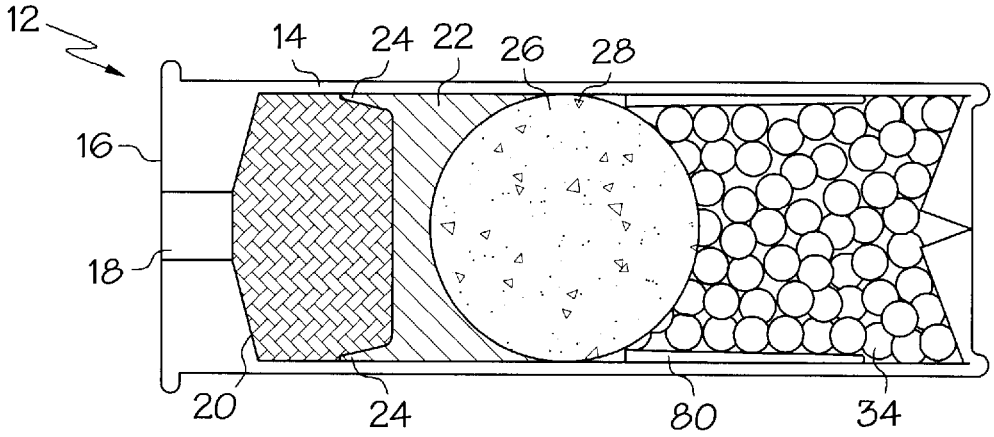
FIG. 14 is an alternative cross-sectional side view of a shotgun shell and indicator.

Referring to FIG. 14, an alternative embodiment of the indicator 26 is illustrated. As may be seen in FIG. 14, the shotgun shell 12 preferably includes a casing 14, primer end 16, an ignition primer 18, propellant 20, and compression wad 22 having gas seals 24. Forwardly to the compression wad 22 is preferably located the indicator 26 which is spherical in shape and includes the ballast 28. In this embodiment, the indicator 26 may be formed of rubber and/or plastic material and may have the ballast 28 intermixed therein. Forwardly from the indicator 26 is preferably positioned a cylindrical shot protector 80 which is utilized to assist in the protection of the bore of the shotgun shell from scrubbing. In this embodiment the spherical indicator 26 is preferably of sufficient size for unaided observation by a sportsman following discharge from a shotgun. The spherical indicator 26 preferably accurately communicates the flight trajectory of expelled shot 34 at a target. It should be noted that the size of the spherical indicator 26 and/or the amount or mass of included ballast 28 may be altered to provide for varying trajectories as desired by an individual. The indicator 26 may also be colored to enhance visibility within varying environmental conditions.

Figure 15:
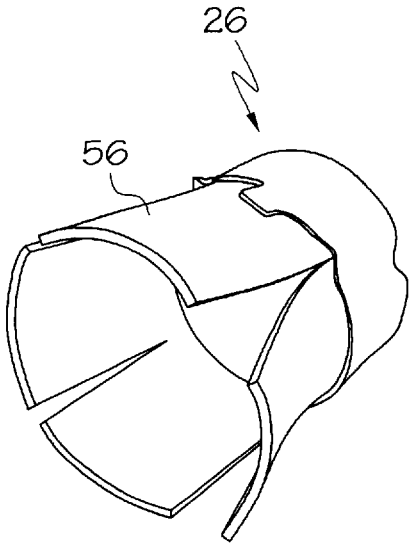
FIG. 15 is a detailed isometric view of an indicator.
Figure 16:
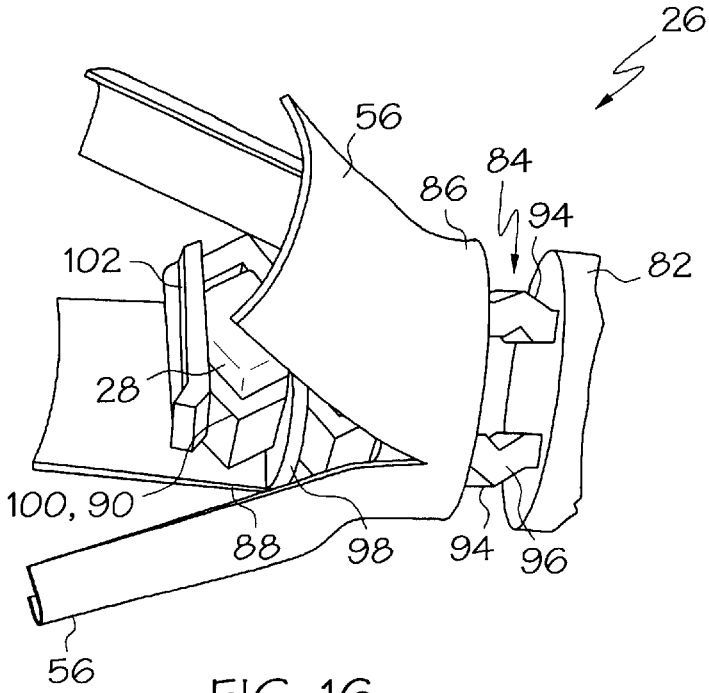
FIG. 16 is a detailed side view of an indicator.
Figure 17:
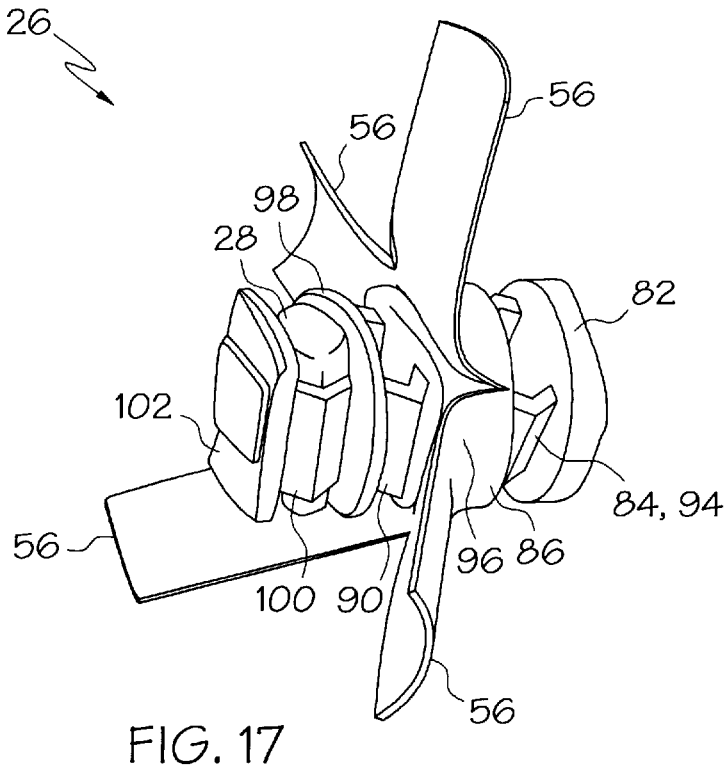
FIG. 17 is a detailed side view of an indicator.
Figure 18:
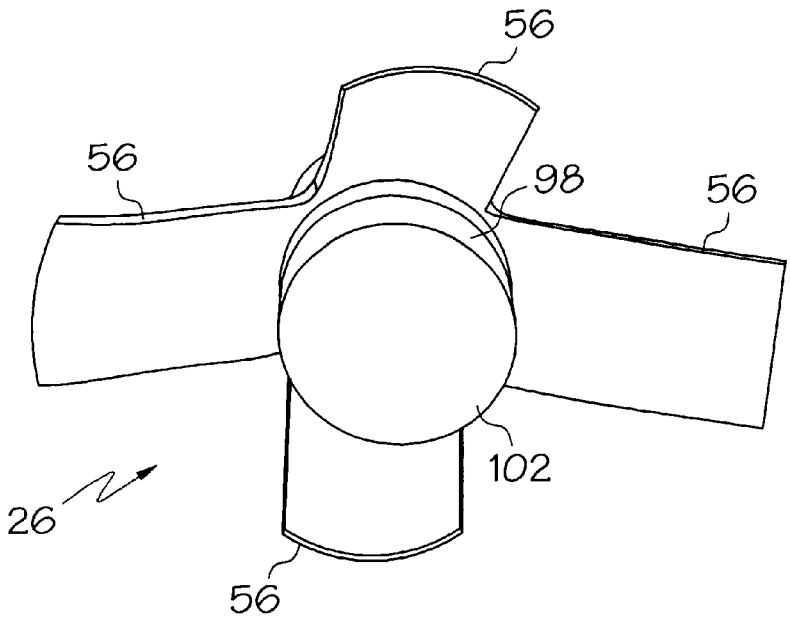
FIG. 18 is a detailed top view of an indicator.
Figure 19:
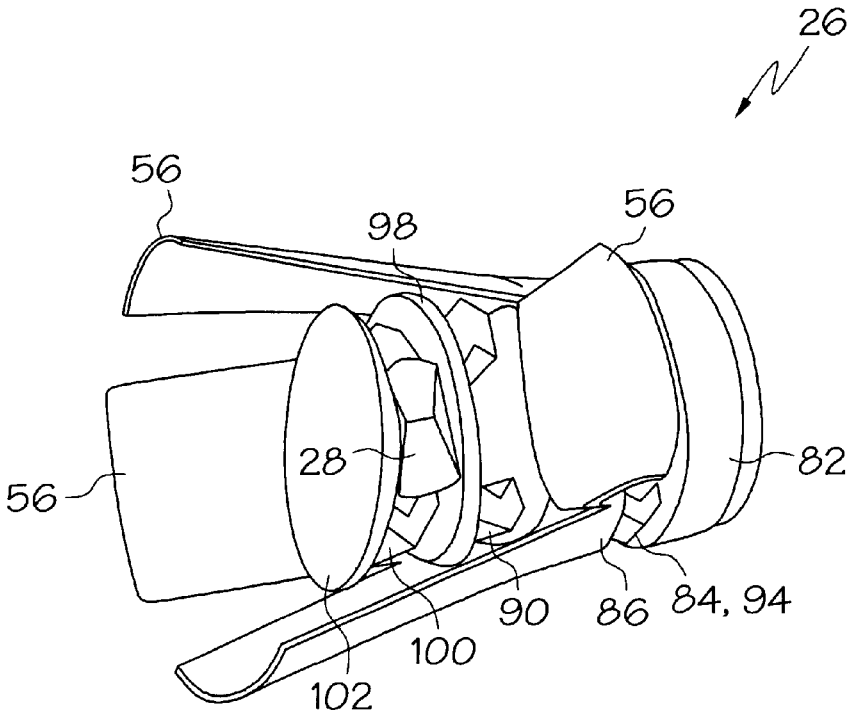
FIG. 19 is a detailed isometric view of an indicator.

Referring to FIG. 15, an indicator 26 is depicted showing four petals 56 extending rearwardly therefrom. The ballast 28 is preferably integral to the base 26. The operation of the indicator 26 as depicted in FIG. 15 is similar to the operation of a badminton birdie as described with respect to the indicators as depicted within FIGS. 1 through 6. In the embodiment as depicted in FIG. 15, the petals 56 may bend following discharge from a shotgun shell barrel at a location adjacent to the indicator 26. Upon the 180° reversal of the position of the indicator 26 during flight, air resistance forces will return the petals 56 to a substantially longitudinal position extending rearwardly from the base 26. It should be further noted that the indicator 26 as included within a shotgun shell 12 prior to discharge is adapted to hold the shot 34 within the interior of the petals 56.

Referring to FIGS. 16–19, an alternative embodiment of the indicator 26 is depicted. In general, the indicator 26 includes a first base 82, a first compression member 84, a second base 86, a support 88 having a second compression member 90, a plurality of petals 56 engaged to the second base 86, and ballast 28 engaged to the support 88.

Figure 20:
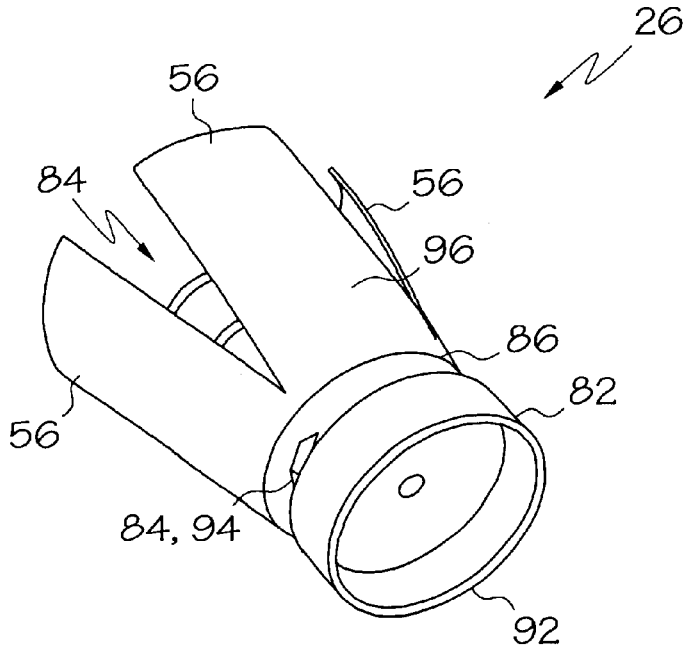
FIG. 20 is an alternative rear isometric view of an indicator.

Continuing to refer to FIGS. 16–19, the first base 82 is preferably cylindrical in shape. The first base 82 may be of one piece solid construction and/or may include a hollow receiving cavity 92 as depicted within FIG. 20.

Forwardly from the first base 82 preferably extends the first compression member 84. The first compression member 84 may be formed of one or more angled or arcuate braces 94 which are preferably adapted to compress and expand outwardly permitting the movement of the first base 82 toward the second base 86 during ignition of the propellant 20 and discharge of the shotgun shell 12. The first compression member 84 preferably assists to cushion the acceleration of the indicator 26 and shot 34 upon discharge of the shotgun shell 12.

The second base 86 like the first base 82 is preferably disc shaped and is of sufficient durability to not fracture during use of the indicator 26 within a shotgun shell 12. The petals 56 are preferably integral and/or secured to the second base 86. In operation the indicator 26 as expelled from a shotgun barrel continues with a trajectory which does not rotate 180° and does not function similar to a badminton birdie. In this embodiment, the petals 56 fold rearwardly toward the first base 82 about a transition area 96 which is proximate to the second base 86. The thickness dimension selected for the petals 56 thereby provides for the resilient folding of the petals 56 to create a desired aerodynamic effect for the indicator 26 during flight. It should be noted that the ballast 28 and support 88 preferably are the forward most portions of the indicator 26 during flight when used to approximate the trajectory of shot 34 as expelled from a shotgun shell 12.

Extending outwardly from the second base 86 is preferably the support 88. The support 88 is formed of at least one second compression member 90. The ballast 28 may be positioned interior to the second compression member 90 at the preference of an individual. In the embodiment depicted in FIGS. 16–19, the second compression member extends outwardly from the second base 86 terminating in a support disc 98. A third compression member 100 extends outwardly from the support disc 98 terminating in a second support disc 102. The second support disc 102 is preferably circular in shape, and during flight, functions as the forward most portion of the indicator 26 to represent the trajectory of the expelled shot 34 from the shotgun shell 12. The ballast 28 as depicted in FIGS. 16–19 is disposed between the support disc 98 and the second support disc 102 within the interior of the third compression member 100. In operation, the ignition of the propellant 20 and the discharge of the shotgun shell 12 causes the first compression member 84 to expand outwardly to permit movement of the first base 82 towards the second base 86. Immediately thereafter, the movement of the second base 86 forwardly causes the expansion of the second compression member 90 outwardly to permit movement of the second base 86 towards the support disc 98. In this manner a cushion is provided for the acceleration of the shot 34 as disposed adjacent to the second support disc 102 within the interior to the petals 56. The peak barrel pressure exposed to the shotgun barrel is thereby reduced.

Following discharge from the shotgun barrel the petals 56 encounter air resistance forcing the petals 56 backwardly into the second in flight position 78. The petals 56 fold backwardly about the transition area 96. The aerodynamic resistance desired for the indicator 26 may be regulated through the selection of a desired thickness dimension for the transition area 96. The unaided visually observable size of the indicator 26 may therefore be enlarged or reduced dependent upon the outward extension of the petals 56 relative to the first and second bases 82,86 respectively. It should be noted that the petals 56 when folded rearwardly may also function to provide a desired aerodynamic trajectory for the indicator 26 which may rotate about an axis and function similar to fletching of an arrow as earlier described. It should be further noted that the size of the ballast 82 selected for inclusion within the indicator 26 may vary significantly at the discretion of an individual to provide for either an enhanced or reduced velocity for the indicator 26 dependent upon a desired type of sporting activity.

Figure 21:
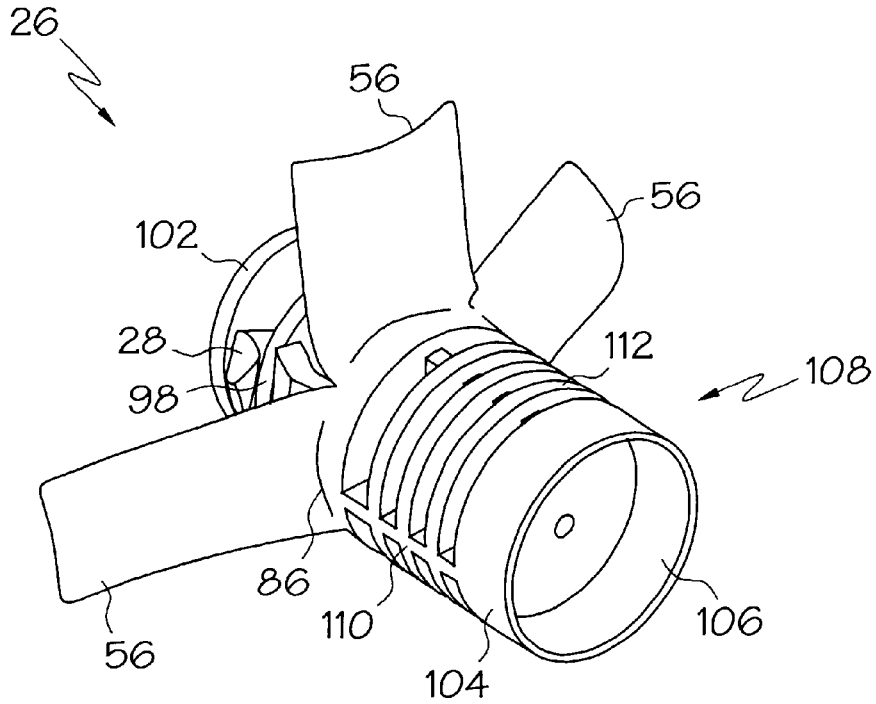
FIG. 21 is an alternative rear isometric view of an indicator.
Figure 22:
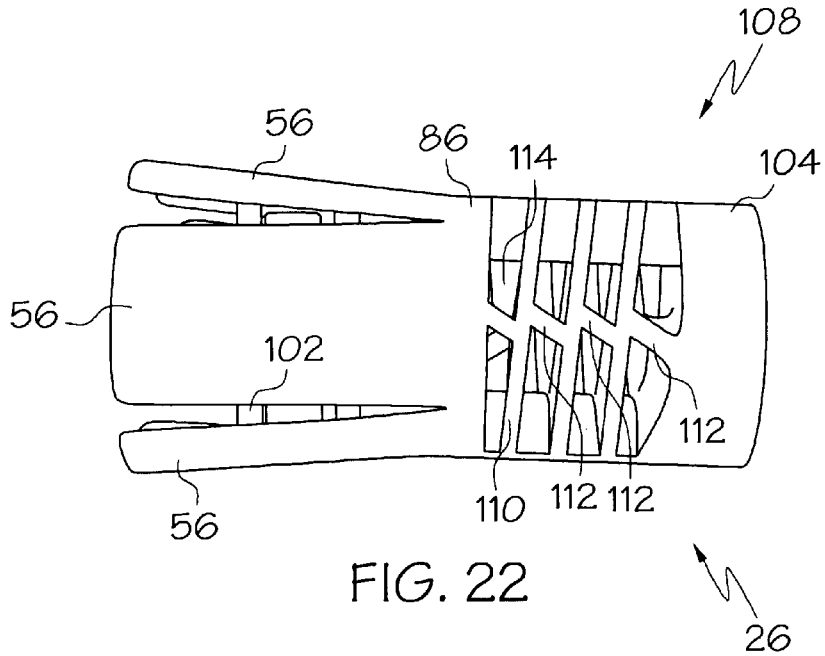
FIG. 22 is an alternative side view of an indicator.
Figure 23:
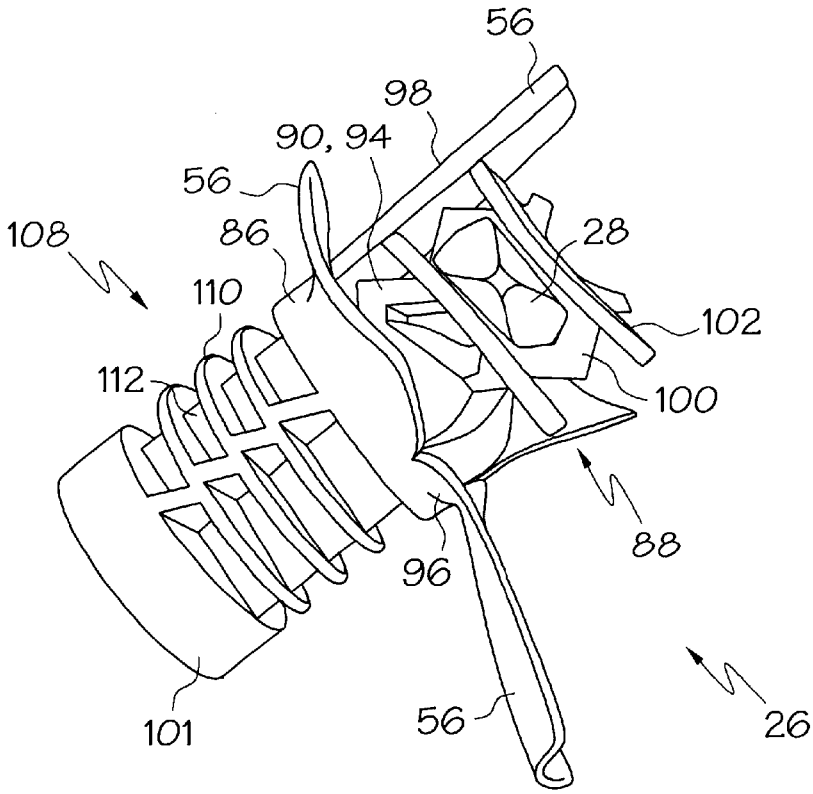
FIG. 23 is an alternative side view of an indicator.

Referring to FIGS. 21–23, an additional alternative embodiment of the indicator 26 is disclosed. In general, the operation of the petals 56, second support disc 102, third compression member 100, support disc 98, transition area 96, angled arcuate braces 94, second compression member 90, support 88, and second base 86 are identical to the description previously supplied with reference to FIGS. 16–20. Within FIGS. 21–23, the first base 104 includes a recessed cavity 106 which is adapted for positioning adjacent to the propellant 20. Extending from the first base 104 is preferably the first compression member 108 which is formed of one or more ribs 110 separated by the use of angularly offset braces 112. Following discharge of the propellant 20, the first base 104 will move forwardly compacting the first compression member 108 which in turn will cushion the acceleration of the shot 34 reducing the peak barrel pressure exposed to a shotgun barrel. The forward movement of the first base 104 toward the second base 86 is not required to completely compress the ribs 110 and angularly offset braces 112. It should be noted that one or more of the adjacent ribs 110 and angularly offset braces 112 may be compressed where remaining ribs 110 and angularly offset braces 112 continue to be substantially intact following the discharge of the shotgun shell 12. A plurality of openings 114 are preferably located between the ribs 110 and angularly offset braces 112 between the first base 104 and second base 86. The provision of a plurality of openings 114 assists in the aerodynamic efficiency of the indicator 26 during flight to provide a desired velocity and trajectory to represent the flight path of the expelled shot 34.

Figure 24:
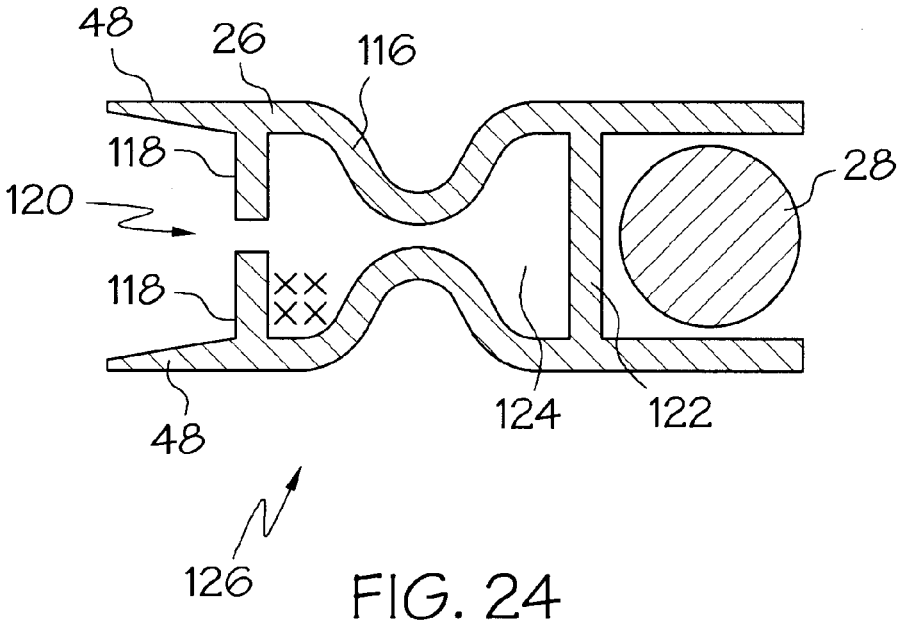
FIG. 24 is an alternative cross-sectional side view of an indicator.
Figure 25:
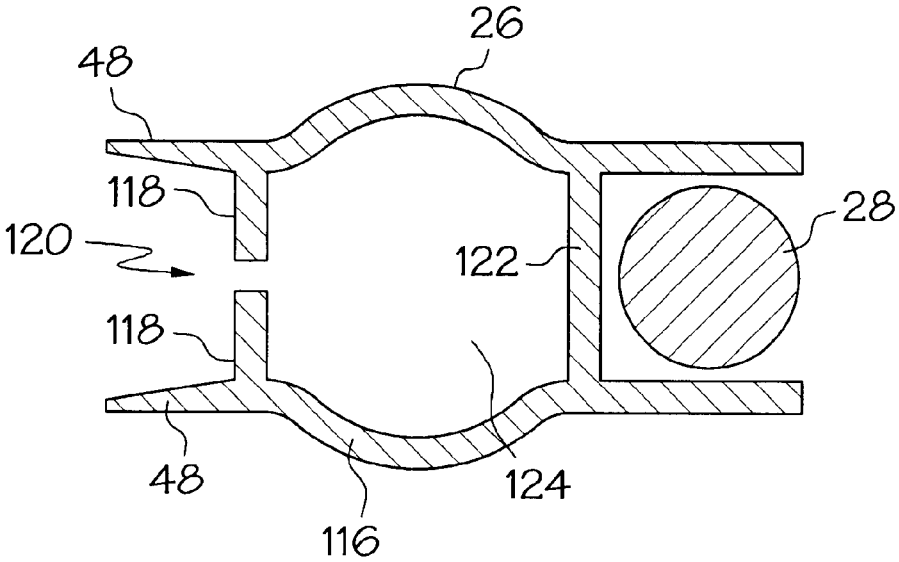
FIG. 25 is an alternative cross-sectional side view of the indicator of FIG. 24.

Referring to FIGS. 24 and 25, an alternative embodiment of the indicator 26 is disclosed. As depicted in FIGS. 24 and 25, the indicator 26 preferably includes an expansible support wall 116. The rearward edge of the expansible support wall 116 preferably includes a gas seal 48. Proximate to the gas seal 48 is preferably located a first ledge 118 having a central opening 120 therein. Proximate to the forward end of the expansible support wall 116 is preferably located a ballast support 122 which defines an internal compartment or pocket 124. Slow activating powder 126 may be disposed within the internal compartment or pocket 124 as depicted in FIG. 24. The expansible support wall 116 may extend beyond the ballast support 122 to establish a cylindrical ridge which is adapted to position the ballast 28 and to affix the ballast 28 to the indicator 26.

Upon the discharge of the shotgun shell 12 the propellant 20 will ignite. The central opening 120 provides a pathway for ignition of the slow activating powder 126 within the internal compartment or pocket 124. Following the discharge of the indicator 26 from the interior of a shotgun barrel the ignition of the slow activating powder 126 will cause the expansible wall 116 to distend as depicted in FIG. 25 thereby enlarging the surface area of the indicator 26 available for unaided observation by a sportsman.

Figure 26:
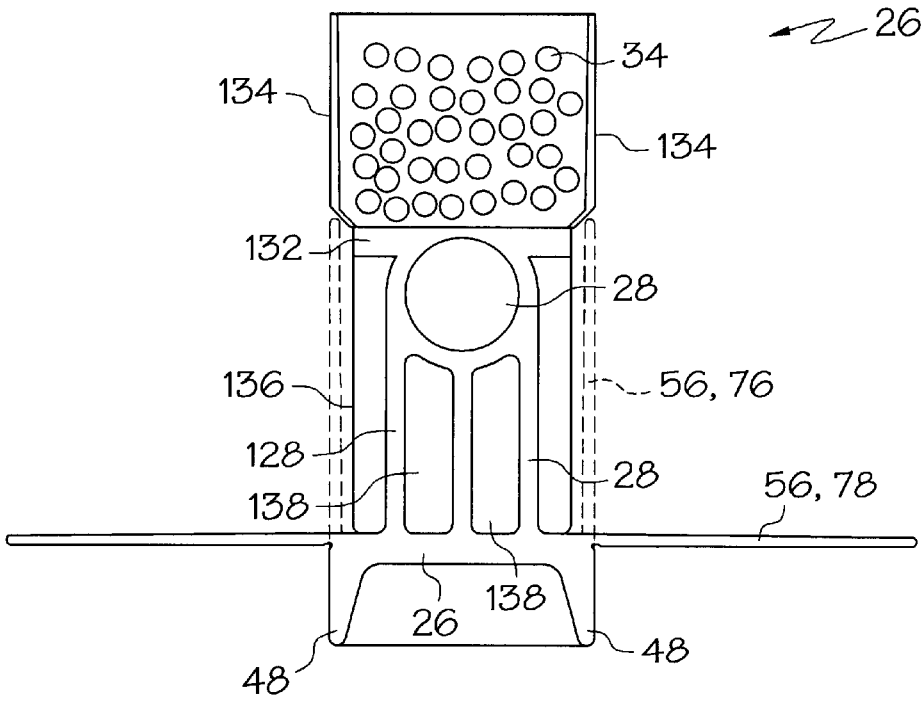
FIG. 26 is a detailed partial phantom line side view of an indicator.
Figure 27:
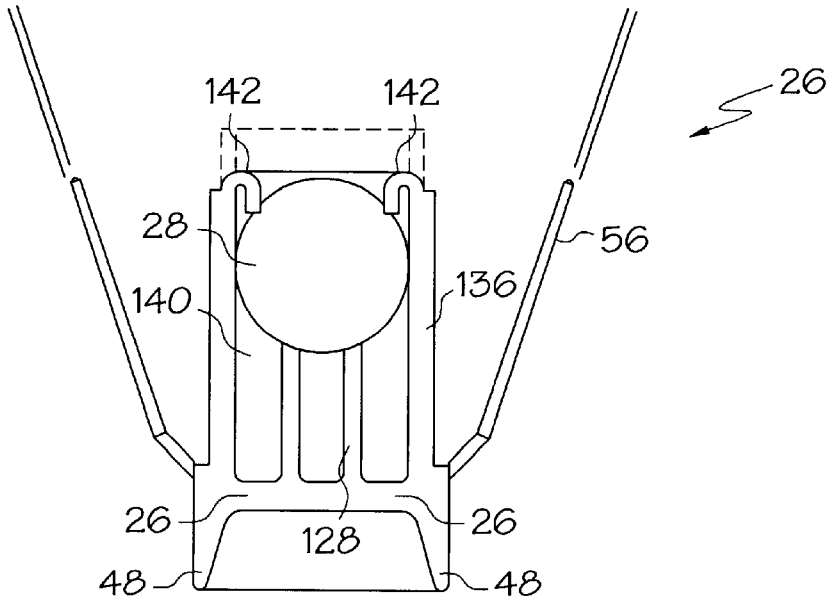
FIG. 27 is an alternative detail partial phantom line side view of an indicator.

An alternative embodiment of the indicator 26 is depicted in FIGS. 26 and 27. Referring specifically to FIG. 26 an indicator 26 is disclosed having gas seals 48. Extending upwardly from the indicator 26 are petals 56 displayed in phantom line in the first position 76 and displayed in the second in flight position at 78. Interior to the petals 56 is preferably located a plurality of columns 128 which terminate in a ballast receiving region 130 having ballast 28. Above the ballast 28 is preferably located a platform 132. The columns 128 may alternatively be referred to as support beams at the preference of an individual. Extending upwardly from the platform 132 and releasably attached thereto is preferably a cylindrical shaped breakaway shot protector 134 which is preferably adapted to hold shot 34. The indicator 26 also preferably includes an exterior wall 136 to add further structural strength and stability to the indicator 26 in addition to the columns and/or support beams 128. Between adjacent support beams 128 is preferably located beam spaces 138 which are openings between adjacent columns 128.

Following discharge of the shotgun shell 112, the indicator 26 immediately upon discharge from a shotgun barrel will encounter air resistance. The air resistance exposed to the breakaway shot protector 134 is preferably sufficient to fracture the breakaway shot protector 134 and separate the shot protector 134 from the platform 132. The indicator 26 will then draft the expelled shot 34 following the identical trajectory as the shot 34 proximate to a target.

Specifically referring to FIG. 27, the beam spaces 138 may be filled with a polymer filler 140 at the discretion of an individual. In addition, the ballast 28 may be affixed to the indicator 26 by roll crimps 142 which replace the platform 132 to secure the ballast 28 to the exterior walls 136 and columns and/or support beams 128 during use of the indicator 26.

Figure 29:
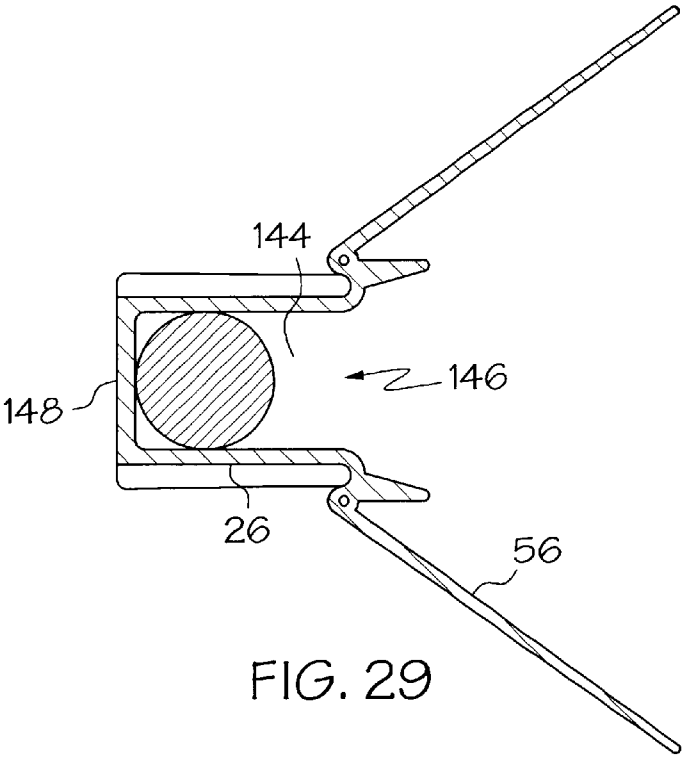
FIG. 29 is an alternative cross-sectional side view of an indicator.
Figure 28:
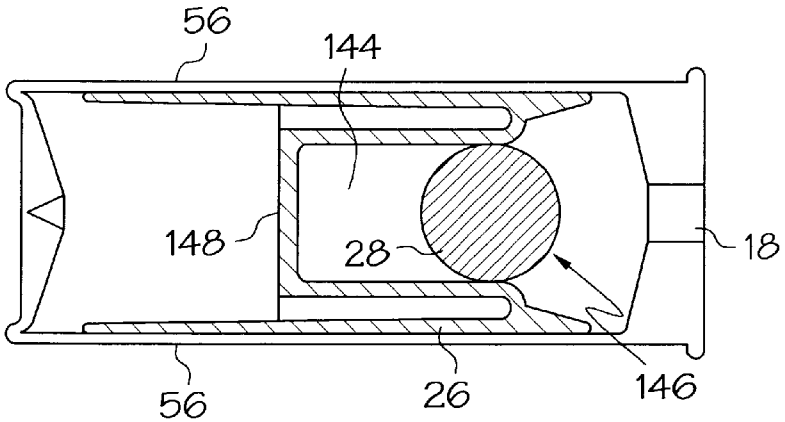
FIG. 28 is an alternative cross-sectional side view of an indicator.

An alternative embodiment of the indicator 26 is depicted in FIGS. 28 and 29. In this embodiment, the indicator 26 is preferably formed of expansible wings 56 and an elongate pocket 144. The elongate pocket 144 preferably includes an open end 146 and an closed ledge 148. Ballast 28 is preferably disposed and positioned adjacent to the open end 146 prior to discharge of the shotgun shell. Prior to the discharge of the shotgun shell the ballast 28 is also positioned proximate to the ignition primer 18. The expansible wings 56 are preferably positioned forwardly away from the ignition primer 18 towards the opening of the shotgun shell barrel to hold shot 34 and to reduce scrubbing of the shotgun shell barrel as earlier described.

Following ignition of the shotgun shell, the ballast 28 moves forwardly within the elongate ballast pocket 144 for positioning proximate to the closed ledge 148. During flight, the expansible wings 56 preferably fold backwardly to assist in the provision of desired aerodynamic characteristics for the indicator 26. The movement of the ballast 28 within the elongate pocket 144 reduces peak barrel pressure to the shotgun shell barrel as earlier described. In addition, the ballast 28 may provide a sealing function such as a gas plug. It should be noted that the ballast 28 may be positioned at varying depths within the ballast pocket 144 to adjust for space filling requirements of a shotgun shell wad. It should be further noted that the provision of adjustable space filling within a ballast pocket 144 may be utilized to satisfy or meet the space filling requirements of the wad for a shotgun shell for all embodiments as earlier described. As depicted in FIG. 29, following discharge of a shotgun shell, the closed ledge 148 is the forward most portion of the indicator 26 drafting behind expelled shot 34. The expansible wings 56 preferably fold rearwardly to a flight position to enhance aerodynamics of the indicator 26 and to simultaneously improve unaided observation by an individual.

During use, the indicator 26 preferably has a velocity which is approximately equal to the expelled shot 34 for a distance of approximately 40 yards from a shotgun. In addition, in a preferred embodiment the indicator 26 has a maximum range of providing unaided observation to reflect the trajectory of expelled shot for approximately 150 yards.

It should be noted that enlargement or reduction of the size of the indicator 26 may adjust the illusion of the speed and distance traveled by the indicator 26 so that the indicator 26 appears to pass through a fast moving crossing target as the target is broken.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A shotgun shell comprising:

a) a shotgun shell casing having an ignition primer, said casing further having an interior;

b) propellant positioned in said casing proximate to said primer;

c) a single non-combustible, non-luminous, non-liquid indicator positioned in said casing, said indicator comprising a base and at least one petal, said at least one petal comprising a hinge proximate to said base, said indicator having an observable size whereby discharge of said propellant expels said indicator from said casing and from a shotgun barrel for unaided observation of said non-combustible, non-luminous, non-liquid indicator; and d) at least one ballast member engaged to said base, said at least one ballast member having a mass wherein said base has a flight trajectory where said base leads said indicator during flight for representation of the trajectory of objects expelled from said shotgun barrel.

2. The shotgun shell according to claim 1, wherein said at least one ballast member is spherical in shape.

3. The shotgun shell according to claim 2, further comprising a cylindrical shot protector adjacent to said indicator, said shot protector adapted for holding shot and for protecting an interior of a shotgun barrel after discharge of said propellant.

4. The shotgun shell according to claim 1, said indicator further comprising a pocket having a bridge and an opening opposite to said bridge, said indicator further comprising a plug disposed in said opening, said at least one ballast member being disposed in said pocket between said plug and said bridge.

5. The shotgun shell according to claim 4, said plug having an at rest position proximate to said propellant and an operational position adapted for compaction of said at least one ballast member within said pocket.

6. The shotgun shell according to claim 1, said indicator further comprising a first compression member proximate to said at least one ballast member.

7. The shotgun shell according to claim 6, said indicator further comprising a platform engaged to said first compression member.

8. The shotgun shell according to claim 7, wherein said at least one petal is engaged to said platform.

9. The shotgun shell according to claim 8, said indicator further comprising a support engaged to said platform interior to said at least one petal, said support comprising a second compression member, said at least one ballast member engaged to said support.

10. The shotgun shell according to claim 9, said indicator further comprising a recessed cavity proximate to said propellant.

11. The shotgun shell according to claim 8, said first compression member comprising a plurality of ribs.

12. The shotgun shell according to claim 1, said indicator comprising:

a) an expansible support wall having a gas seal proximate to said propellant;

b) a ballast support traversing said expansible support wall;

c) a first ledge traversing said expansible support wall opposite to said ballast support, said first ledge having a central opening;

d) a pocket between said first ledge, said expansible support wall, and said ballast support; and e) slow activating powder disposed in said pocket wherein ignition of said propellant ignites said slow activating powder through said opening for expanding said expansible support wall.

13. The shotgun shell according to claim 1, said indicator comprising:

a first ledge proximate to said base, said at least one petal engaged to said indicator proximate to said ledge;

a plurality of support beams extending away from said first ledge;

a second ledge engaged to said support beams opposite to said first ledge, where said at least one ballast member is engaged to said support beams and to said second ledge; and a breakaway shot protector engaged to said second ledge opposite to said support beams, said breakaway shot protector adapted for holding shot within said shotgun shell.

14. The shotgun shell according to claim 1, further comprising two or more indicators.

15. The shotgun shell according to claim 1, further comprising a plurality of ballast members.

* * * * *